US007088309B2

(12) United States Patent
Sakurada et al.

(10) Patent No.: US 7,088,309 B2
(45) Date of Patent: Aug. 8, 2006

(54) LENS ANTENNA

(75) Inventors: Kiyoyasu Sakurada, Moriyama (JP); Hiroshi Nongaki, Shiga-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/188,023

(22) Filed: Jul. 1, 2002

(65) Prior Publication Data

US 2003/0011533 A1 Jan. 16, 2003

(30) Foreign Application Priority Data

Jul. 4, 2001 (JP) ..... 2001-203438

(51) Int. Cl.
*H01Q 15/08* (2006.01)

(52) U.S. Cl. ..... 343/911 R; 343/911 L

(58) Field of Classification Search ..... 343/911, 343/911 R, 786, 753, 872, 909, 911 L
See application file for complete search history.

(56) References Cited

U.S. PATENT DOCUMENTS

| | | | | |
|---|---|---|---|---|
| 3,866,234 | A * | 2/1975 | Gates et al. | 343/911 R |
| 4,511,868 | A * | 4/1985 | Munson et al. | 333/257 |
| 6,008,755 | A * | 12/1999 | Ishikawa et al. | 342/175 |
| 6,036,893 | A | 3/2000 | Lier et al. | |
| 6,195,058 | B1 * | 2/2001 | Nakamura et al. | 343/753 |
| 6,433,936 | B1 * | 8/2002 | Carpenter et al. | 359/652 |
| 6,594,928 | B1 * | 7/2003 | Clawson et al. | 40/310 |
| 6,618,196 | B1 * | 9/2003 | Ikari et al. | 359/457 |
| 6,659,625 | B1 * | 12/2003 | Hanasaki | 362/311 |
| 2002/0136899 | A1 * | 9/2002 | deRojas et al. | 428/412 |

FOREIGN PATENT DOCUMENTS

| | | |
|---|---|---|
| DE | 196 22 755 A1 | 12/1997 |
| EP | 1 095 708 A1 | 5/2001 |
| JP | 4-185105 | 7/1992 |
| JP | 05-083018 | 4/1993 |
| JP | 6-8128 | 4/1994 |
| JP | 07-030324 | 1/1995 |
| JP | 8-24246 | 3/1996 |
| JP | 2758899 | 3/1998 |
| JP | 11-269294 | 5/1999 |
| JP | 11-227012 | 8/1999 |
| JP | 2979736 | 9/1999 |
| JP | 2000-219725 | 8/2000 |
| JP | 2000-272290 | 10/2000 |
| JP | 2001-057065 | 2/2001 |
| JP | 2001-123762 | 5/2001 |
| JP | 2001-144523 | 5/2001 |

OTHER PUBLICATIONS

Copy of Japanese Examination Report dated Nov. 9, 2004 (and English translation of same).

(Continued)

*Primary Examiner*—Tho Phan
(74) *Attorney, Agent, or Firm*—Dickstein, Shapiro, Morin & Oshinsky, LLP.

(57) ABSTRACT

A lens antenna including a lens body and/or a matching layer. In the lens antenna, lens body may be formed by a material containing thermoplastic elastomers. When a matching layer is formed on the surface of the lens body, at least one of the lens body and the matching layer is formed by a material containing thermoplastic elastomers. The use of thermoplastic elastomers in the lens body and/or the matching layer assist in reducing the formation of cracks therein.

11 Claims, 1 Drawing Sheet

OTHER PUBLICATIONS

Jing, G., "Technological Development of Thermoplastic Elastomers Abroad", PetroChemical Industry Trends, vol. 6, No. 5, pp. 41-47 (1998).

Copy of The People's Republic of China Office Action dated Dec. 3, 2004 (and English translation of same).

* cited by examiner

LENS ANTENNA

BACKGROUND OF THE INVENTION

1. Field of the Invention

The present invention relates to a lens antenna.

2. Description of the Related Art

In recent years, active research and development have been going on for producing various types of ITS (Intelligent Transport Systems) suitable for use in a new generation. As a result, more and more functions have been used to ensure safe travel in an automobile. In particular, an outside environment detection system, which serves as an eye for an automobile, is considered to be the most important among various types of ITS. For example, there has been developed a detection system using an infrared ray or CCD. However, each of the known detection systems has been found unsuitable for use in rainy weather, or too expensive in their production cost.

In view of the above, it is desirable to use, as an outside environment detection system, a radar which employs a millimeter wave (76 GHz). An antenna suitable for receiving such a millimeter wave is a lens antenna.

A conventional lens antenna comprises a lens body and a primary echo transmitter provided behind the lens body. Further, in order to reduce an electromagnetic wave reflection from the surface of the lens body, a matching layer may be provided on the surface of the lens body. In practice, the lens body as well as the matching layer may be formed by dielectric ceramics and thermoplastic resins.

However, with the above-described conventional lens antenna, a high temperature condition will cause the surface of the lens body or the matching layer to become oxidized and thus deteriorated, so that the lens body will be repeatedly exposed to an undesired thermal expansion or shrinkage. As a result, a stress remaining within the lens body will be applied to the surface thereof or to the matching layer, resulting in cracks occurring in the lens body or the matching layer.

Whenever such cracks occur, not only will the appearance of the lens antenna become worse, but also moisture will invade into the lens antenna, bringing about an undesired change in the lens characteristic. As a result, it will be difficult for the lens antenna to provide a desired gain.

SUMMARY OF THE INVENTION

Accordingly, it is an object of the present invention to provide an improved lens antenna having an excellent resistance against cracks due to thermal expansion or thermal shrinkage.

According to a first aspect of the present invention, there is provided a lens antenna comprising a lens body and a primary echo transmitter provided behind the lens body, wherein the lens body comprises a material containing thermoplastic elastomers.

With the use of the above arrangement, it is possible to prevent the occurrence of cracks in the lens body. This is because the thermoplastic elastomers have a desired rubber elasticity which is useful for relaxing stresses caused by thermal expansion or thermal shrinkage of the lens body.

According to a second aspect of the invention, there is provided a lens antenna comprising a lens body, a matching layer formed on the surface of the lens body, and a primary echo transmitter provided behind the lens body, wherein at least one of the lens body and the matching layer comprises a material containing thermoplastic elastomers.

With the use of the above arrangement, it is possible to prevent the occurrence of cracks in the lens body as well as in the matching layer.

According to a third aspect of the present invention the lens body comprises a material containing dielectric ceramics.

With the use of the above arrangement, it is possible to increase the dielectric constant of the lens body, thereby allowing the lens body to be made thinner.

According to a fourth aspect of the present invention the lens body and the matching layer comprises materials containing dielectric ceramics.

With the use of the above arrangement, it becomes possible to adjust the dielectric constants of both the lens body and the matching layer, thereby ensuring a conformity between the two members. Preferably, if the dielectric constant of the lens body is $\in r_a$ and the dielectric constant of the matching layer is $\in r_b$, and if the two dielectric constants are in a condition satisfying an equation of $\in r_b = (\in r_a)^{1/2}$, it is possible to obtain a maximum conformity between the lens body and the matching layer, as well as to ensure a minimum reflection from the lens body.

On the other hand, when the matching layer comprises a material containing dielectric ceramics, as may be understood from the above equation, it may be necessary to increase the dielectric constant of the lens body. Therefore, it is preferable that the lens body also be formed of a material containing dielectric ceramics. For this reason, it is not preferred that only the matching layer is formed from a material containing dielectric ceramics.

DESCRIPTION OF THE PREFERRED EMBODIMENTS

Figure 1:
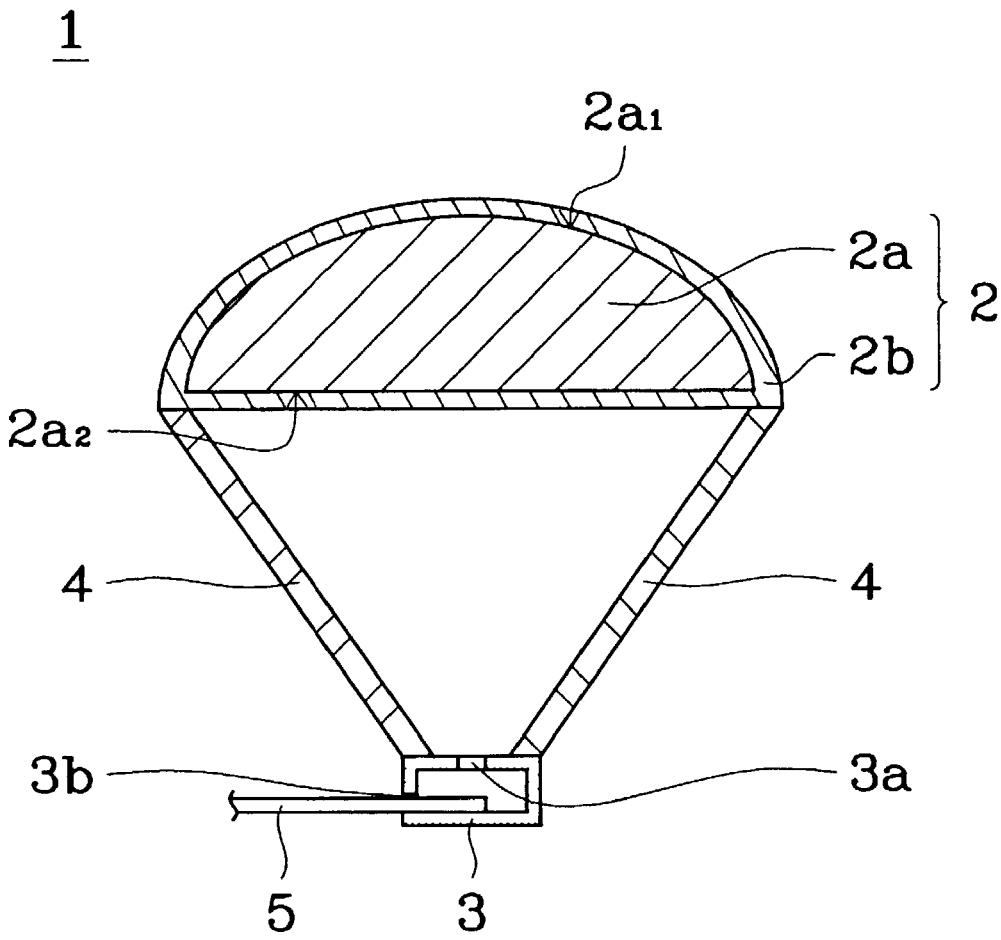
FIG. 1 is cross-section showing a lens antenna formed according to the present invention.

The lens antenna of the present invention includes a lens body made of a material containing thermoplastic elastomers. However, if a matching layer is to be formed on the surface of the lens body, at least one of the lens body and the matching layer is preferably formed from a material containing thermoplastic elastomers.

As defined herein, a material containing thermoplastic elastomers can also contain, in addition to the thermoplastic elastomers, resins (but excluding any thermoplastic elastomers), dielectric ceramics and the like.

Thermoplastic elastomers which can be used in the present invention include styrene thermoplastic elastomers and polyolefin thermoplastic elastomers. Preferable, stylene thermoplastic elastomers include styrene-butadiene-styrene block copolymer (SBS), styrene-isoprene-styrene block copolymer (SIS), styrene-ethylene-butylene-styrene block copolymers (SEBS), styrene-ethylene-propylene-styrene block copolymers (SEPS). In particular, it is preferable to use SEBS and SEPS since they have excellent thermal resistance and excellent weatherability.

Preferable polyolefin thermoplastic elastomers (TPO) include three types of materials (1) a blended type formed by dispersing an amount of rubber particles in a resin, (2) an implant type which can be formed by copolymerizing (in a step-by-step manner) an amount of hard segments and an amount of soft segments in a reaction process, and (3) a dynamic vulcanized type which can be formed by mixing together an olefin resin, an unvulcanized rubber and a vulcanizing agent in a mixing apparatus, with such a mixing being carried out at a high temperature. However, it is preferable to use the dynamic vulcanized type TPO, since this type allows rubber particles to be dispersed sufficiently, thereby realizing a high rubber elasticity.

The dynamic vulcanized TPO is preferably formed by mixing olefin resin chips, such as polypropylene (PP) resin chips and polyethylene (PE) resin chips with ethylene propylene rubber (EPDM) chips as well as nitryl rubber chips, followed by extruding the thus formed mixture together with a cross linking agent, such as sulfur and a peroxide. In particular, it is preferable to use PP-EPDM elastomers since they have excellent thermal resistance and excellent durability.

Additional resins which can be used in the present invention, but which are not thermoplastic elastomers, are polyethylene, polypropylene, polystyrene, syndiotactic polystyrene, liquid crystal polymer, polyphenylene sulfide, ABS resin, polyester resin, polyacetal, polyamide, methyl penten polymer, norbornane resin, polycarbonate, polyphenylene ether, polysulfone, polyimide, polyether imide, polyamide imide, and polyether ketone. In particular, it is preferable to use polyethylene, polypropylene, polystyrene, syndiotactic polystyrene, liquid crystal polymer and polyphenylene sulfide, since they have an excellent Q value.

As dielectric ceramics which can be used in the present invention, it is preferable to use $CaTiO_3$, $Al_2O_3$, $MgTiO_3$, $TiO_2$, $CaCO_3$, $BaTiO_3$, $Ca_2P_2O_7$, $Mg_2SiO_4$, $Ca_2MgSi_2O_7$, $Ba(Mg_{1/3}Ta_{2/3})O_3$, and the like.

The particle size of the above-described dielectric ceramics is preferred to be 0.05 to 50 μm, and the specific surface area thereof is preferred to be 1.00 to 3.00 $cm^2/g$.

In the case where a matching layer is formed on the surface of the lens body, the material used to form such a matching layer preferably contains the thermoplastic elastomers in an amount of 30 to 100 vol %. By containing the thermoplastic elastomers in such a percentage, it is possible to obtain a lens antenna having an excellent crack resistance.

FIG. 1 shows a lens antenna 1 formed according to the present invention. As shown in FIG. 1, the lens antenna 1 includes a lens section 2, a wave guide (a primary echo transmitter) 3, and a support section 4 for engaging and thus supporting the lens section 2 and the primary echo transmitter 3.

The lens antenna 1 is fabricated so that at least one of the lens body 2*a* and the matching layer 2*b* is formed by a material containing thermoplastic elastomers.

Thus, the lens section 2 is formed by the lens body 2*a* and the matching layer 2*b*, with the lens body 2*a* including a convex emission surface 2*a*1 and a flat incidence surface 2*a*2. Specifically, the emission surface 2*a*1 is preferably formed so that its vertical cross section is a half-ellipse. In practice, such a lens section may be formed using an injection molding process. The matching layer 2*b* may be provided for obtaining a conformity between the lens body 2*a* and the atmospheric air, and is formed to cover the outer edge of the lens body 2*a*, rendering itself to be tightly attached to the lens body 2*a*. In particular, it is preferable that the matching layer 2*b* has a dielectric constant which is equal to or at least close to the square root of the dielectric constant of the lens body 2*a*. Further, the matching layer 2*b* is preferred to have a thickness which is approximately ¼ of the wavelength of a desired micro wave.

The wave guide 3 is made of aluminum and has a rectangular parallelepiped shape, with its upper side having an echo transmission opening 3*a* and its side wall having an insertion opening 3*b*. Specifically, the opening 3*a* and the opening 3*b* are communicated with each other through the internal space of the wave guide.

The support section 4 extends from the outer circumference of the wave guide 3 and has a tapered configuration in connection with the entire outer circumferential edge of the lens section. The support section is provided to fix a positional relation between the wave guide 3*a* and the lens section 2. Further, it is preferable that a metal layer be plated on the internal surface of the support section 4 so as to reflect an electromagnetic wave.

One end of a dielectric wire 5 is inserted into the wave guide 3 through the insertion opening 3*b*, in a manner such that this one end of the wire 5 is located in a position corresponding to the echo transmission opening 3*a*. Although not shown in the drawing, an electrode is formed on this end of the dielectric wire 5.

EXAMPLE

The following is a description explaining how to manufacture the preferred embodiments of the lens body and the matching layer of the lens antenna of the present invention.

First, the weight of several sorts of resin powders and several sorts of dielectric ceramic powders are taken using a balance so as to prepare materials A to N shown in Table 1. Then, an extruder of a biaxial type with its cylinder temperature at 200° C. is used to knead and thus mix together the various materials in a melted state so as to obtain a kneaded admixture. The obtained admixture is thereafter forced through a head hole so as to be formed into a thread-like (strand) material which is then cooled in water and subsequently cut into pellets. Preferably, each pellet has a diameter of 2 mm and a length of 5 mm. It is also possible to crush the admixture produced by the extruder into pellets by means of a crusher.

When preparing a composite dielectric material containing several sorts of resins and several sorts of dielectric ceramics represented by F to N in Table 1, the corresponding resin powders and the corresponding dielectric ceramic powders can be premixed in a mixer prior to kneading. On the other hand, as to some resin powders which cannot be obtained in the form of powder, it is possible to carry out a pretreatment such as freezing.

The pellets formed of the materials A to N shown in Table 1 are then introduced into an injection molding machine in which they are melted at a temperature of 200° C. and then extruded into disc-like circular plates having a diameter of 53 mm and a thickness of 1.3 mm. The disc-like circular plates are measured for their dielectric properties represented by dielectric constant ∈r and Q value (1/tanδ), preferably using a disturbance method involving TE01δ mode and an electric field of 12 GHz. The measurement results of materials A to N are shown in Table 1.

TABLE 1

| | Material | Composition ratio (vol %) | ∈r (12 GHz) | Q (12 GHz) |
|---|---|---|---|---|
| A | PP | 100.0 | 2.23 | >10000 |
| B | SEBS | 100.0 | 2.32 | 650 |
| C | SEPS | 100.0 | 2.33 | 700 |
| D | TPO | 100.0 | 2.19 | 5000 |
| E | PP | 70.0 | 2.22 | 7000 |
| | TPO | 30.0 | | |

TABLE 1-continued

| | Material | Composition ratio (vol %) | εr (12 GHz) | Q (12 GHz) |
|---|---|---|---|---|
| F | PP | 88.8 | 3.98 | 2000 |
| | CT | 11.2 | | |
| G | PP | 65.0 | 4.03 | 2778 |
| | Alumina | 35.0 | | |
| H | PP | 50.0 | 6.77 | 710 |
| | CT | 10.0 | | |
| | Alumina | 40.0 | | |
| I | TPO | 88.5 | 4.01 | 1800 |
| | CT | 11.5 | | |
| J | TPO | 77.0 | 6.60 | 700 |
| | CT | 23.0 | | |
| K | TPO | 75.0 | 4.03 | 7000 |
| | MT | 25.0 | | |
| L | TPO | 90.0 | 2.60 | 4000 |
| | Alumina | 10.0 | | |
| M | TPO | 65.0 | 3.99 | 2750 |
| | Alumina | 35.0 | | |
| N | PP | 50.0 | 4.02 | 1400 |
| | SEBS | 39.0 | | |
| | CT | 11.0 | | |

In Table 1, the abbreviations used represent the following materials:
PP: Polyethylene
SEBS: Styrene-ethylene-butylene-styrene block copolymer
SEPS: Styrene-ethylene-propylene-styrene block copolymer
TPO: Polyolefin thermoplastic elastomers
CT: Calcium titanate
MT: Magnesium titanate In the preferred embodiment, the pellets formed of materials F to K, M and N are then introduced into an injection molding machine in which they are melted at a temperature of 200° C. and then extruded into convex lens-like objects each having a diameter of 73.2 mm and a maximum thickness of 20 mm. Then, a metal mold is prepared corresponding to the shape of the lens body. The metal mold is designed so that a gap of 0.1 mm is formed between the mold and the lens body when the lens body is completely covered by the metal mold. Subsequently, the lens body was covered up by the metal mold having a temperature range extending from the room temperature to 120° C., and an amount of pellets formed by materials A to E and L are injected into the gap so as to form a matching layer having a thickness of 1 mm on the surface of the lens body.

With the above process, 16 samples were obtained which were injection molded products. The lens body and the matching layer of each sample are shown in Table 2. Each of samples 1 to 7 represents a lens body formed by a material not containing thermoplastic elastomers and a matching layer formed by a material containing thermoplastic elastomers. Each of samples 8 and 9 represents a lens body formed by a material containing thermoplastic elastomers and a matching layer formed by a material not containing thermoplastic elastomers. Each of samples 10 to 14 represents both a lens body and a matching layer formed by materials containing thermoplastic elastomers. Further, in each of the samples listed in Table 2 the lens body contains dielectric ceramics, while in each of samples 7 and 14 the matching layer also contains dielectric ceramics. In addition, samples 15 and 16 each marked by * in Table 2 are comparative examples not falling within the scope of the claims of the present invention, and represent lens bodies and matching layers formed by materials not containing thermoplastic elastomers.

TABLE 2

| Sample No. | Lens body | Matching layer | Time period lasting until crack occurrence (hour) |
|---|---|---|---|
| 1 | F (PP/CT) | B (SEBS) | 2000 |
| 2 | F (PP/CT) | C (SEBS) | 3000 |
| 3 | F (PP/CT) | D (TPO) | >5000 |
| 4 | G (PP/Alumina) | D (TPO) | >5000 |
| 5 | F (PP/CT) | E (PP/TPO) | 2000 |
| 6 | H (PP/CT/Alumina) | D (TPO) | >5000 |
| 7 | H (PP/CT/Alumina) | L (TPO/Alumina) | >5000 |
| 8 | N (PP/SEBS/CT) | A (PP) | 1500 |
| 9 | I (TPO/CT) | A (PP) | 3000 |
| 10 | N (PP/SEBS/CT) | D (TPO) | >5000 |
| 11 | I (TPO/CT) | D (TPO) | >5000 |
| 12 | K (TPO/MT) | D (TPO) | >5000 |
| 13 | M (TPO/Alumina) | D (TPO) | >5000 |
| 14 | J (TPO/CT) | L (TPO/Alumina) | >5000 |
| *15 | F (PP/CT) | A (PP) | 72 |
| *16 | G (PP/Alumina) | A (PP) | 144 |

The various samples in Table 2 were put into an oven so as to perform a heat resistance test at a high temperature of 105° C. In this heat resistance test, a time period was measured lasting from the start of the test till the occurrence of cracks in the matching layers. The measurement results are shown in Table 2.

It may be understood from Table 2 that cracks did not easy occur in the samples in which lens bodies and matching layers are formed by materials containing thermoplastic elastomers.

Although the lens antenna 1 obtained in the above-described embodiments has a matching layer 2*b* formed on the surface of the lens body 2*a*, the present invention can also be applied to an example where the matching layer 2*b* is not formed, but where the lens body 2*a* is formed by a material containing thermoplastic elastomers. With this construction it is also possible to obtain the same effect of preventing crack occurrence.

The lens antenna of the present invention comprises a lens body and a primary echo transmitter provided behind the lens body. Specifically, the lens body consists of a material containing thermoplastic elastomers.

In the case where the matching layer is formed on the surface of the lens body, at least one of the lens body and the matching layer is preferably formed by a material containing thermoplastic elastomers.

In this way, it is possible to make full use of a rubber elasticity of the thermoplastic elastomers, so as to alleviate a stress caused due to thermal expansion or thermal shrinkage of the lens body, thereby inhibiting the occurrence of cracks in the lens body as well as in the matching layer.

Further, using dielectric ceramics in the lens body makes it possible to increase the dielectric constant of the lens body, thereby allowing the lens body to be made in a reduced thickness.

In addition, by incorporating electric ceramics into the lens body and as well as into the matching layer, it is possible to perform a fine adjustment of a conformity between the lens body and the matching layer.

Although the present invention has been described in relation to particular embodiments thereof, many other variations and modifications and other uses will become apparent to those skilled in the art. Accordingly, the present invention is not limited by the specific disclosure herein, but only by the appended claims.

What is claimed is:

1. A lens antenna comprising:

a lens body; and a wave guide provided behind the lens body, wherein the lens body comprises a material containing a thermoplastic elastomer, the thermoplastic elastomer is selected from the group consisting of styrene thermoplastic elastomers and polyolefin thermoplastic elastomers, and the styrene thermoplastic elastomers are selected from the group consisting of styrene-butadiene-styrene block copolymers, styrene-isoprene-styrene block copolymers, styrene-ethylene-butylene-styrene block copolymers, styrene-ethylene-propylene-styrene block copolymers.

2. A The lens antenna according to claim 2 comprising:

a lens body; and a wave guide provided behind the lens body, wherein the lens body comprises a material containing a thermoplastic elastomer, the thermoplastic elastomer is selected from the group consisting of styrene thermoplastic elastomers and polyolefin thermoplastic elastomers, and the polyolefin thermoplastic elastomers are selected from the group consisting of a blended-type, an implant type and a dynamic vulcanized type.

3. A lens antenna comprising:

a lens body; and a wave guide provided behind the lens body, wherein the lens body comprises a material containing a thermoplastic elastomer, the material of the lens body further includes at least one dielectric ceramic material, and the dielectric ceramic material is selected from the group consisting of $CaTiO_3$, $Al_2O_3$, $MgTiO_3$, $TiO_2$, $CaCO_3$, $BaTiO_3$, $Ca_2P_2O_7$, $Mg_2SiO_4$, $Ca_2MgSi_2O_7$ and $Ba(Mg_{1/3}Ta_{2/3})O_3$.

4. A lens antenna comprising:

a lens body; and a wave guide provided behind the lens body, wherein the lens body comprises a material containing a thermoplastic elastomer, the material of the lens body further includes at least one dielectric ceramic material, and the dielectric ceramic material has a particle size of from about 0.05 to about 50 μm.

5. A lens antenna comprising:

a lens body; and a wave guide provided behind the lens body, wherein the lens body comprises a material containing a thermoplastic elastomer, the material of the lens body further includes at least one dielectric ceramic material, and the dielectric ceramic material has a surface area from about 1.00 to about 3.00 $cm^2/g$.

6. A lens antenna comprising:

a lens body;

a matching layer formed on a surface of the lens body; and a wave guide provided behind the lens body, wherein at least one of the lens body and the matching layer comprises a material containing a thermoplastic elastomer, the thermoplastic elastomer is selected from the group consisting of styrene thermoplastic elastomers and polyolefin thermoplastic elastomers, and the styrene thermoplastic elastomers are selected from the group consisting of styrene-butadiene-styrene block copolymers, styrene-isoprene-styrene block copolymers, styrene-ethylene-butylene-styrene block copolymers, styrene-ethylene-propylene-styrene block copolymers.

7. A lens antenna comprising:

a lens body;

a matching layer formed on a surface of the lens body; and a wave guide provided behind the lens body, wherein at least one of the lens body and the matching layer comprises a material containing a thermoplastic elastomer, the thermoplastic elastomer is selected from the group consisting of styrene thermoplastic elastomers and polyolefin thermoplastic elastomers, and the polyolefin thermoplastic elastomers are selected from the group consisting of a blended-type, an implant type and a dynamic vulcanized type.

8. A lens antenna comprising:

a lens body;

a matching layer formed on a surface of the lens body; and a wave guide provided behind the lens body, wherein at least one of the lens body and the matching layer comprises a material containing a thermoplastic elastomer, the material of the lens body further includes at least one dielectric ceramic material, and the dielectric ceramic material is selected from the group consisting of $CaTiO_3$, $Al_2O_3$, $MgTiO_3$, $TiO_2$, $CaCO_3$, $BaTiO_3$, $Ca_2P_2O_7$, $Mg_2SiO_4$, $Ca_2MgSi_2O_7$ and $Ba(Mg_{1/3}Ta_{2/3})O_3$.

9. A lens antenna comprising:

a lens body;

a matching layer formed on a surface of the lens body; and a wave guide provided behind the lens body, wherein at least one of the lens body and the matching layer comprises a material containing a thermoplastic elastomer, the material of the lens body further includes at least one dielectric ceramic material, and the dielectric ceramic material has a particle size of from about 0.05 to about 50 μm.

10. A lens antenna comprising:

a lens body;

a matching layer formed on a surface of the lens body; and a wave guide provided behind the lens body, wherein at least one of the lens body and the matching layer comprises a material containing a thermoplastic elastomer, the material of the lens body further includes at least one dielectric ceramic material, and the dielectric ceramic material has a surface area from about 1.00 to about 3.00 $cm^2/g$.

11. A lens antenna comprising:

a lens body;

a matching layer formed on a surface of the lens body; and a wave guide provided behind the lens body, wherein at least one of the lens body and the matching layer comprises a material containing a thermoplastic elastomer, the material of the lens body and the material of the matching layer further include at least one dielectric ceramic material, and the dielectric ceramic material is selected from the group consisting of $CaTiO_3$, $Al_2O_3$, $MgTiO_3$, $TiO_2$, $CaCO_3$, $BaTiO_3$, $Ca_2P_2O_7$, $Mg_2SiO_4$, $Ca_2MgSi_2O_7$ and $Ba(Mg_{1/3}Ta_{2/3})O_3$.

* * * * *